United States Patent [19]

Liljenfeldt

[11] Patent Number: 4,930,474

[45] Date of Patent: Jun. 5, 1990

[54] DISTRIBUTION AND CONTROL VALVE FOR A FUEL INJECTION PUMP

[75] Inventor: Gösta Liljenfeldt, Solf, Finland

[73] Assignee: Oy Wärsilä Ab, Helsinki, Finland

[21] Appl. No.: 348,601

[22] Filed: May 4, 1989

[30] Foreign Application Priority Data

May 16, 1988 [FI] Finland ..... 882275

[51] Int. Cl.[5] ..... F02M 39/00

[52] U.S. Cl. ..... 123/300; 123/451

[58] Field of Search ..... 123/299, 300, 451, 447, 123/446

[56] References Cited

U.S. PATENT DOCUMENTS

| | | | |
|---|---|---|---|
| 3,392,715 | 7/1968 | Thoma | 123/299 |
| 3,394,891 | 7/1968 | Voit | 123/299 |
| 4,064,845 | 12/1977 | Bart | 123/300 |
| 4,178,141 | 12/1979 | Scheying | 123/451 |
| 4,201,160 | 5/1980 | Fenne | 123/300 |
| 4,289,098 | 9/1981 | Norberg | 123/299 |
| 4,389,987 | 6/1983 | Frankle | 123/300 |

FOREIGN PATENT DOCUMENTS

| | | | |
|---|---|---|---|
| 641322 | 1/1937 | Fed. Rep. of Germany | 123/300 |
| 2647788 | 4/1978 | Fed. Rep. of Germany | 123/451 |
| 0197468 | 11/1983 | Japan | 123/300 |

*Primary Examiner*—Carl Stuart Miller

*Attorney, Agent, or Firm*—Dellett, Smith-Hill & Bedell

[57] ABSTRACT

The invention relates to a distribution and control valve in a fuel injection engine pump especially for a large multi-cylinder diesel engine, in which the fuel is injected into the cylinder by mdans of two or more injection valves (A;B). The pump includes a pump cylinder (1) and, inside thereof in a pump chamber (2), a reciprocatingly movable piston member (4), which is arranged through its movement to feed fuel via distribution ducts to the injection valves of the cylinder in question. The pump cylinder (1) is provided with an extra chamber (11) connected to the pump chamber (2), to which extra chamber there is tightly adapted a long-shaped valve member (12) following the movements of the piston member in the axial direction thereof, and inside the valve member (12) there is a fuel duct (13) connected to the pump chamber (2). The feed ducts (**16;5*a*,5*b*) of the separate valves are connected to the extra chamber (11) in the axial direction of the valve member (12) to different points distant from each other. The valve member (12) is provided with control and feeding means to direct fuel in a desired way from the pump chamber (2) to the feed ducts (16; 5*a*, 5*b***) of each injection valve (A;B).

9 Claims, 4 Drawing Sheets

DISTRIBUTION AND CONTROL VALVE FOR A FUEL INJECTION PUMP

Figure 1:
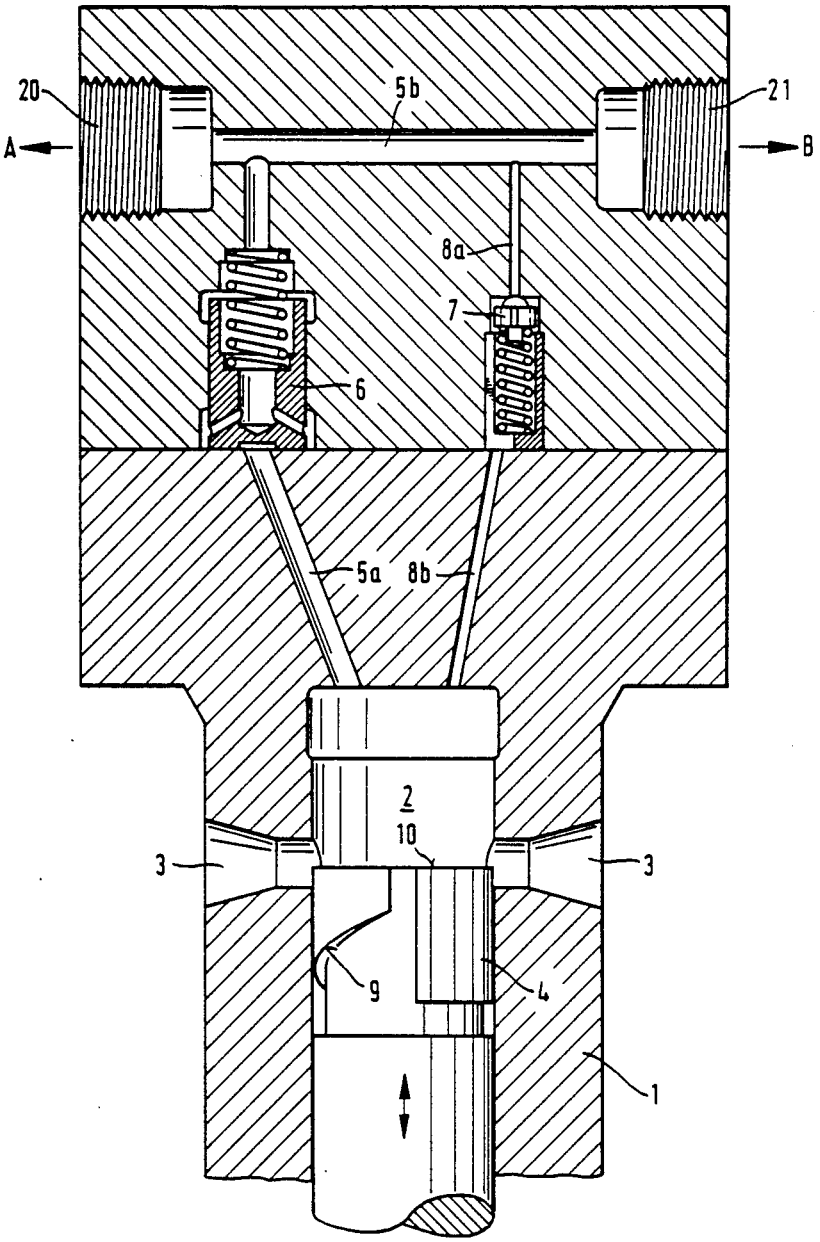

The invention relates to a distribution and control valve for a fuel injection pump, particularly on a large multi-cylinder diesel engine.

In this context a large diesel engine is taken to mean the sort of engine used in ships as the main or auxiliary engine, or in diesel power stations. If such diesel engines use a fuel with poor ignition properties, there is a distinct risk of knocking and associated problems when the engine is fitted with conventional fuel injection equipment. For this reason multi stage fuel injection systems have started to be used in diesel engines. As it is desirable also to make the engine as economical as possible, an important feature in modern diesel engines is that each cylinder should be fed in the optimum way the exact amount of fuel to take advantage of the correct timing, the shortest possible injection period, the shape of the combustion chamber and the amount of air present in the combustion chamber. In a large diesel engine it is expedient to fit each cylinder with two or more injection valves, each of which may have its own properties relating to timing and fuel injection spray.

According to conventional single pump solutions, the same pump feeds fuel to all the injection valves of a cylinder by means of a branching duct system, but employing only one connecting duct to the pump chamber. By employing several injection valves the shape of the combustion chamber and the amount of air present in the combustion chamber can be used to the optimum way. The difficulty remains, however, that this solution limits or makes it impossible to use different injection times and different lengths of the injection phase in separate injection valves for the same cylinder.

Solutions employing several pumps, wherein each individual injection valve has its own pump cylinder, provide various options as regards both distribution of the fuel to the combustion chamber and settings, as well as timing and duration of injection for each individual injection valve. The major disadvantage is that using several pump cylinders leads to higher costs and problems of space, as to each motor cylinder must be fitted several pump cylinders. In addition, such solutions, based on using several pump cylinders are not as reliable as single pump solutions.

The object of the invention is to achieve a new fuel injection arrangement for diesel engines, based on the single pump solution, but having two or more injection valves per cylinder, so that it will be flexible in operation and, at the same time combine the advantages of the single pump and multi pump solutions while eliminating the disadvantages thereof. The aim is to achieve an application which will enable a large diesel engine to use in addition to conventional diesel fuels also fuels with poor ignition properties.

The aims of the invention are achieved in the manner described in detail in claim 1 and in the subclaims. According to the invention a pump cylinder has an extra chamber connected to the pump chamber, tightly enclosing a long-shaped valve member which follows the movements of the piston member in its axial direction. Inside this valve member is a fuel distribution duct connected to the pump chamber. The feed ducts of the separate valves are connected to the extra chamber in different places some distance from each other in the axial direction of the valve member. In addition, for directing fuel from the pump chamber to the feed duct of each injection valve, the valve member is provided with control and feeding means, which together with the feed ducts are arranged to be positioned relative to each other so that fuel feed to separate injection valves can be arranged to take place at least partly at different times. Thus, in a simple way the control and distribution valve according to the invention can be used both when fuel is to be injected periodically and also in such applications using nozzles with variable aperture size, whereby the total nozzle aperture area in each case can be controlled during the injection by the amount of the injection valves or valve segments connected to the pump.

In order to make it easier to feed fuel and to improve the control possibilities, the feed ducts are connected to the extra chamber with a control groove passing around it. Thus the amount of fuel and the duration it is fed into the feed ducts can be determined by means of the control and feeding means in the valve member and/or the dimensions of the control grooves.

The control and feeding means can have one or several feed apertures to connect the distribution duct of the valve member to the feed ducts.

In practice it is an advantage if the end of the valve member not adjacent to the piston member is open. Thus the edge of the open end can be arranged to control fuel feed to at least one of the fuel feed ducts. The solution can be adapted to advantage also in such a case that there is in the valve member a spring preferably at least partly situated in the distribution duct inside the valve member by means of which the valve member is pressed against the piston member of the pump.

In one alternative embodiment of the invention the valve member is connected to the piston member so as to constitute an integral part thereof.

When using fuels with poor ignition properties in an engine a good result may be achieved by arranging that the size of the apertures of the injection valve nozzles are different and arranging each fuel feed to the cylinder to take place first via the feed duct that feeds the injection valve with the smallest nozzle aperture. Thus the majority of the fuel will not be injected via the injection valve with the larger nozzle aperture until the fuel fed in advance has already been ignited for certain. With a bigger nozzle aperture size it is possible to use short injection periods and still have a moderate pressure, which serves for the reliability of operation of the fuel injection system. Additionally, such a solution will prevent knocking and associated difficulties.

Figure 2:
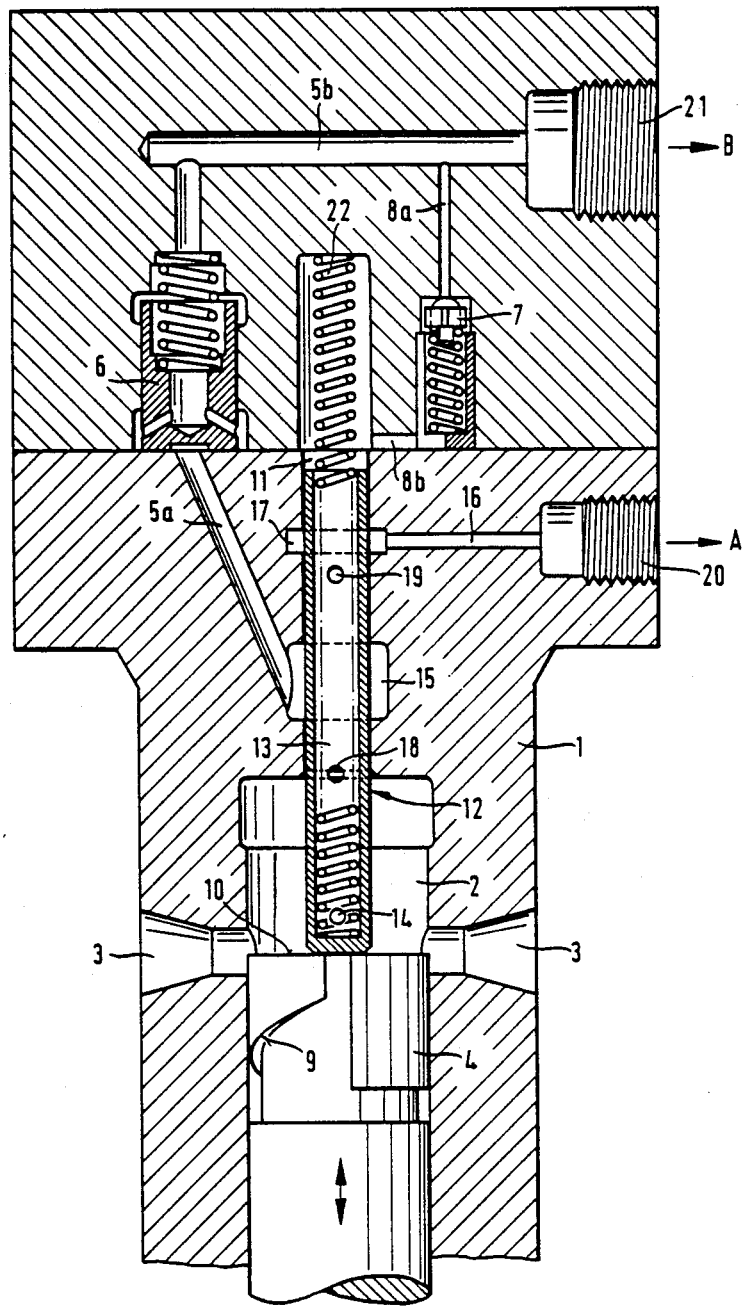
Figure 3:
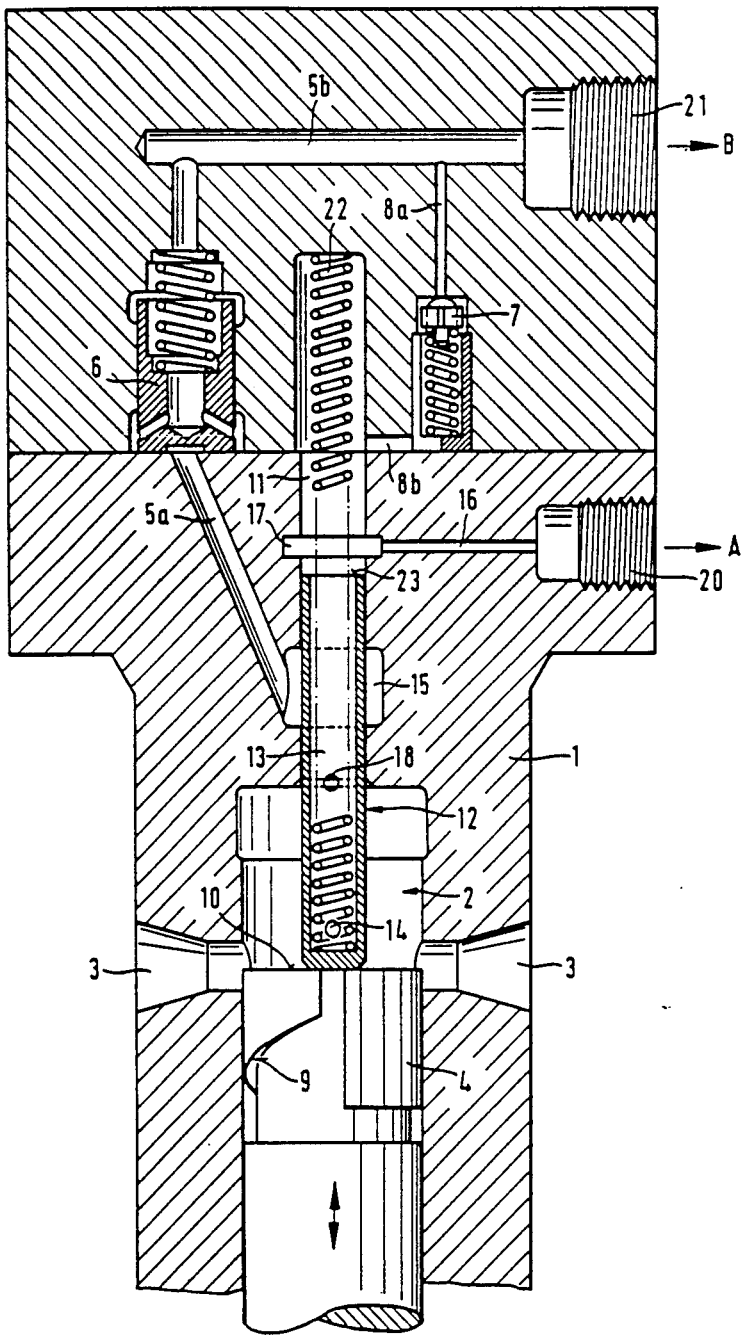
Figure 4:
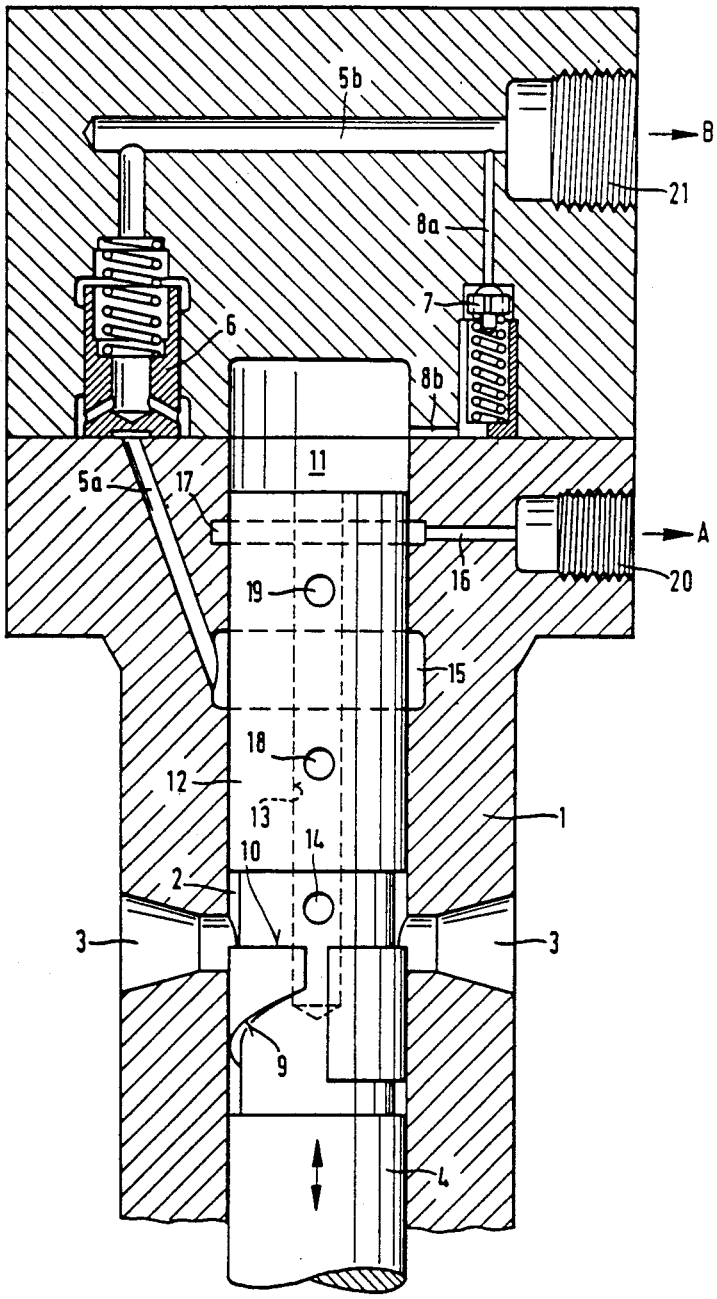

In the following the invention is described more in detail with reference to the attached drawings, in which FIG. 1 shows a sectional view of an injection pump cylinder according to the known art, FIG. 2 shows a sectional view of one embodiment of the invention, FIG. 3 shows a sectional view of a modified embodiment of the invention, FIG. 4 shows a sectional view of a further embodiment of the invention.

With special reference to FIG. 1, numeral 1 in the drawing is a pump cylinder, including a chamber 2 to which fuel is brought via feed apertures 3. In the chamber 2 is a reciprocating piston 4, which pumps fuel from the chamber 2 to one cylinder of a diesel motor via feed ducts 5*a* and 5*b*, a non-return valve 6, and injection valves A and B (not shown). The movements of the piston 4 are synchronized, as known per se, with the movements of the piston of the related cylinder of the motor and they may be controlled mechanically by a cam mechanism. Reference numerals 20 and 21 indicate junction points for pipes through which fuel is fed to the valves A and B. On the other hand the fuel feed duct **5*b* is connected to the chamber 2 also via a relief valve 7 positioned in ducts 8*a* and 8*b*. Fuel injection from the chamber 2 to valves A and B will occur when the piston control edge 10 has covered the feed apertures 3. The length of the effective stroke of the pump piston 4 can be controlled as known per se by providing the piston 4 with a spiral control edge 9**.

FIG. 2 illustrates an embodiment of the invention in which, connected to the chamber 2, there is an extra chamber 11 having a tightly fitted valve member 12 which moves following the axial movements of the piston 4. Inside the valve member 12 is a distribution duct 13, which leads to chamber 2 via an aperture 14, and by which fuel is fed further to the feed ducts of valves A and B via apertures 18 and 19. As is clear from FIG. 2, feed duct 16 of valve A is entirely separate from feed ducts **5*a* and 5*b* of valve B, and opens into a different portion of extra chamber 11 than feed duct 5*b* of valve B. At the junction points of feed ducts 5*a* and 16 and extra chamber 11 control grooves 15 and 17, respectively, are arranged. A spring 22 presses valve member 12 against the pump piston 4**.

The operation of the device is as follows. As the control edge 10 of the piston 4 has passed the feed apertures 3, fuel is forced from the chamber 2 via the aperture 14 into the distribution duct 13 inside the valve member 12. As the piston 4 and valve member 12 move further upwards in FIG. 2, the feed aperture 19 reaches, in a first stage, the position of the control groove 17 of the feed duct 16. At that moment a connection is opened between the chamber 2 and valve A. This connection is closed when aperture 19 has completely passed groove 17. In a second stage, when feed aperture 18 reaches the position of the control groove 15, a connection is correspondingly opened between chamber 2 and valve B.

The starting time and the time relation of the injection of fuel via valves A and B can be altered by changing the distance between the feed apertures 18 and 19. In the same way the fuel injection and its duration can be varied by changing the dimensions of the apertures 18 and 19 and of the control grooves 15 and 17.

The embodiment in FIG. 3 differs from that of FIG. 2 only in that the injection of fuel to feed duct 16 is controlled instead of by means of the aperture 19 by a control edge 23 at one end of the valve member 12. In the embodiment of FIG. 4 the valve member 12 is rigidly connected to the pump piston 4. As a result of this the chamber 2 is reduced to a groove passing around the piston 4, through which fuel is fed via the feed apertures 3, aperture 14 and distribution duct 13 to extra chamber 11 which, in this embodiment acts as the actual pump chamber just as chamber 2 in the embodiment of FIG. 2. In other respects, the embodiments of FIG. 3 and FIG. 4 work in the same manner as described earlier.

The invention is not limited to the embodiments described above but several modifications are feasible within the scope of the attached claims.

I claim:

1. A distribution and control valve in a fuel injection engine pump especially for a large multi-cylinder diesel engine, in which the fuel is injected into the cylinder by means of two or more injection valves (A;B), which pump includes a pump cylinder (1) and, inside thereof in a pump chamber (2), a reciprocatingly movable piston member (4) arranged through its movement to feed fuel via distribution ducts to the injection valves of the cylinder in question, the pump cylinder (1) being provided with an extra chamber (11) connected to the pump chamber (2), said extra chamber (11) enclosing a long-shaped valve member (12) tightly adapted therein and arranged to follow the movements of said piston member (4) in the axial direction thereof, and located inside said valve member (12) a fuel distribution duct (13) connected to said pump chamber (2), the feed ducts (**16;5*a*,5*b*) of the separate valves being connected to said extra chamber (11) in the axial direction of the valve member (12) to different positions at a distance from each other, said valve member (12) being provided with control and feeding means for directing fuel from the pump chamber (2) to the feed ducts (16;5*a*,5*b*) of each injection valve. (A;B), said control and feeding means together with said feed ducts (16;5*a*,5*b***) being arranged to be positioned relative to each other so as to feed fuel to separate injection valves (A;B) at least partly at different times.

2. A control and distribution valve according to claim 1, wherein said feed ducts (**16;5*a*,5*b*) are connected to the extra chamber (11) by a control groove (17;15**) passing around said extra chamber.

3. A control and distribution valve according to claim 2, wherein the amount and duration of the fuel feed to the feed ducts (**16;5*a*,5*b*) is determined by the dimensions of the control and feeding means for the valve member and/or the dimensions of the control grooves (17;15**).

4. A distribution and control valve according to claim 3, wherein the control and feeding means comprise one or several feed apertures (19;18) for connecting the distribution duct (13) of the valve member to said feed ducts (**16;5*a*,5*b***).

5. A distribution and control valve according to claim 4, wherein the end of the valve member (12) not adjacent to the piston member (4) is open.

6. A distribution and control valve according to claim 5, including a spring (22) preferably at least partly positioned in the distribution duct (13) inside the valve member for pressing the valve member (12) against the piston member (4) of the pump.

7. A distribution and control valve according to claim 6, wherein an edge (23) at said open end of the valve member (12) is arranged to control fuel feed to at least one of said feed ducts (16).

8. A distribution and control valve according to claim 7, wherein the valve member (12) is attached to the piston member (4) of the pump so as to be an integral part thereof.

9. A distribution and control valve according to claim 1, wherein the size of the apertures of the nozzles for said injection valves (A;B) is different, whereby fuel feed in each time to the cylinder in question is arranged to take place first via the feed duct feeding fuel to the injection valve with the smallest nozzle aperture.

* * * * *